United States Patent [19]

Bielich

[11] 4,184,488

[45] Jan. 22, 1980

[54] HYDROTHERAPEUTIC FOOT MASSAGER

[76] Inventor: Guillermo J. Bielich, 38002 15th St. E., Palmdale, Calif. 93550

[21] Appl. No.: 887,169

[22] Filed: Mar. 16, 1978

[51] Int. Cl.[2] ..... A61H 9/00

[52] U.S. Cl. ..... 128/66; 4/182; 128/25 B

[58] Field of Search ..... 128/66, 25 B, 366, 375; 4/182, 148

[56] References Cited

U.S. PATENT DOCUMENTS

| | | | |
|---|---|---|---|
| 1,715,043 | 5/1929 | Oye | 4/182 |
| 2,312,524 | 3/1943 | Cox | 4/182 |
| 2,654,894 | 10/1953 | Dijck | 4/182 |
| 3,283,756 | 11/1966 | Turley | 128/66 |
| 3,292,614 | 12/1966 | Fleming | 128/57 |
| 3,965,495 | 6/1976 | McNair | 4/182 |

*Primary Examiner*—Lawrence W. Trapp
*Attorney, Agent, or Firm*—Howard I. Podell

[57] ABSTRACT

A foot massaging device adapted for home use in a bathtub which comprises a hollow casing forming a foot tub having a waterflow inlet for mounting the outlet end of a hose, the inlet end of which is connected to the faucet of the bathtub in which the device is used. The inlet is connected to a first manifold support on a plate in the lower part of the casing and connected to a second manifold by spaced conduits having rows of spaced-apart openings for discharging water outwardly and upwardly against a foot-sole receiving plate having two foot receiving plastic screen sections resulting in a foot massage effect.

3 Claims, 4 Drawing Figures

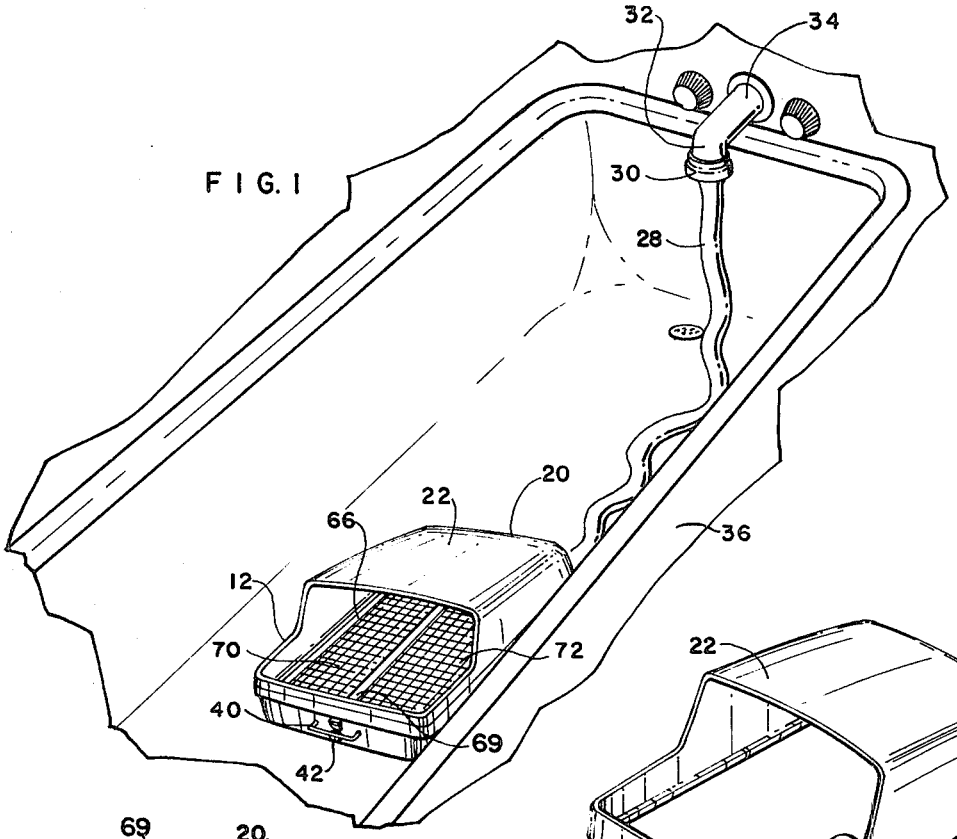
FIG. 1
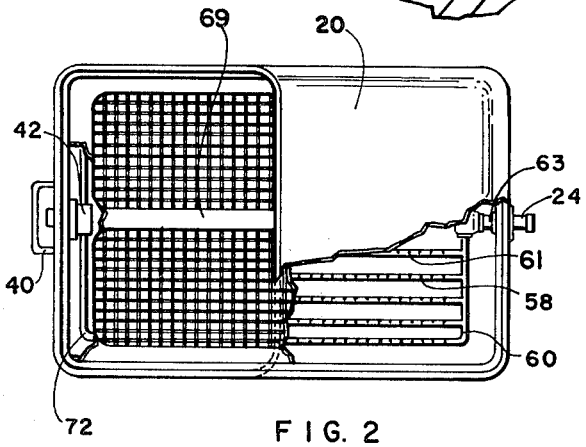
FIG. 2
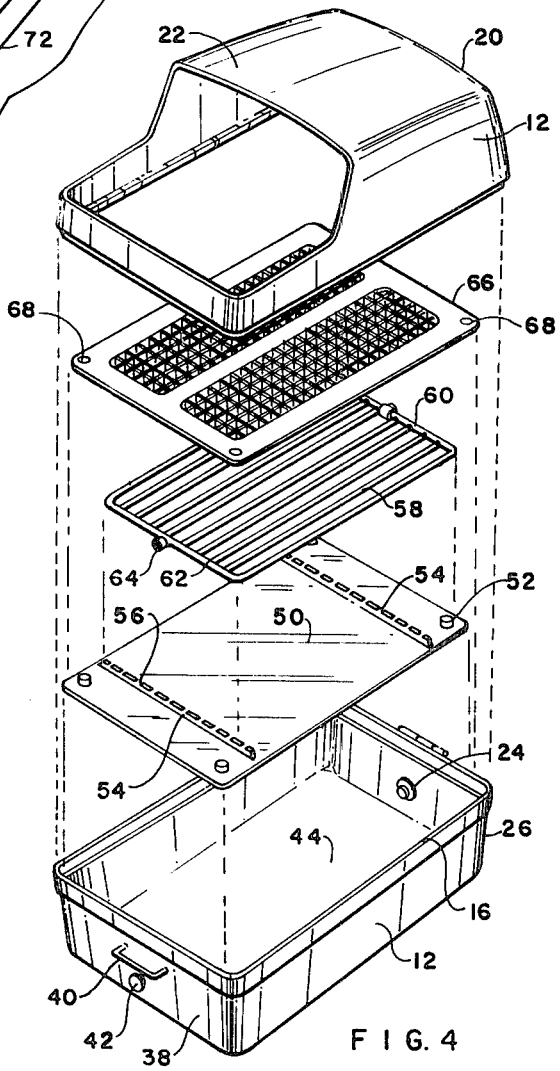
FIG. 4
FIG. 3
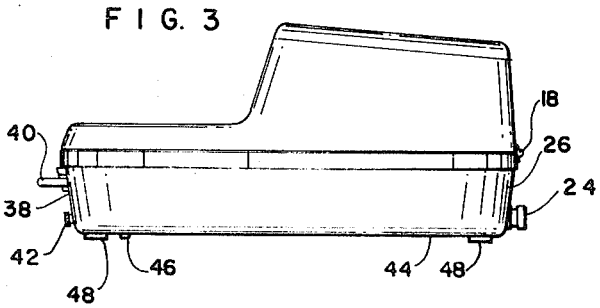

HYDROTHERAPEUTIC FOOT MASSAGER

FIELD OF THE INVENTION

This invention relates generally to a foot massaging device.

STATEMENT OF PRIOR ART

The prior art, exemplified by U.S. Pat. Nos. 3,965,495; 3,380,080; 3,830,232 and 3,881,471 is generally illustrative of various devices of this type. While such devices are generally acceptable for their intended purpose, they have not proven to be entirely satisfactory in that they are either complex and expensive to manufacture, or bulky and inconvenient to use, or require unusual skill and/or dexterity to operate. As a result of the shortcomings of the prior art, typified by the above, there has developed and continues to exist a substantial need for devices of the character described. Despite this need, and the efforts of many individuals and companies to develop such devics, a satisfactory device meeting this need has heretofore been unavailable.

The principal object of this invention is to provide a device or article of this character which combines simplicity, strength and durability in a high degree, together with inexpensiveness of construction.

Other objects of this invention will in part be obvious and in part hereinafter pointed out.

SUMMARY OF THE INVENTION

This invention resides in a foot massaging device adapted for home use in a bathtub which comprises a hollow casing forming a foot tub having a waterflow inlet for mounting the outlet end of a hose, the inlet end of which is connected to the faucet of the bathtub in which the device is used. The inlet is connected to a first manifold support on a plate in the lower part of the casing and connected to a second manifold by spaced conduits having rows of spaced-apart openings for discharging water ouwardly and upwardly against a foot-sole receiving plate having two foot receiving plastic screen sections resulting in a foot massage effect.

BRIEF DESCRIPTION OF THE DRAWING

In the accompanying drawing, in which is shown and illustrated one of the various possible illustrative embodiments of this invention, wherein like reference character identify the same or like parts:

FIG. 1 is a view in perspective showing the foot massager of the invention connected to a conventional tub;

FIG. 2 is a top plan view partly in section of the same;

FIG. 3 is a side elevation thereof; and

FIG. 4 is a view of the device with its constituent parts separated.

DESCRIPTION OF THE PREFERRED EMBODIMENT

With reference to the drawing, there is shown and illustrated a FOOT MASSAGE DEVICE constructed in accordance with the principles of the invention and designated generally by reference character 10.

The device includes a casing 12 made of a suitable high grade molding plastic such as a polycarbonate and has a generally rectangular form. The lower casing portion has a floor and upstanding side and end walls with a peripheral rim or flange portion 16. To one end of flange portion 16 is hinged by hinge 18 an upper casing portion 20 constructed to overhang and cover approximately the forward half of casing 12. The upper casing portion 20 is open directly above the rearward portions of casing 12 to accomodate the feet of the user while its closed area 22 serves to prevent water from splashing out of casing 12.

An inlet 24 is secured in an opening in casing rear wall 26. Its inlet end has external threads for engagement with the outlet end of hose 28 whose inlet end 30 is threaded on adaptor 32 force fitted on, or otherwise secured to faucet 34 of tub 36.

The front wall 38 of the casing has a handle 40 and an outlet valve 42.

The bottom 44 has a drain 46 and support feet 48.

Fitting on bottom 44 is a support plate 50 with posts 52 fixed at each corner. Two spaced rows of notched supports 54 are provided in the front and rear part of plate 50. The notches 56 receive therein and stabilize the conduits 58 connecting manifolds 60 and 62.

Conduits 58 are separated into two rows of 5 to 6 each corresponding to each foot. Each conduit has a plurality of discharge openings 61 arranged to discharge water received from manifold 60 outwardly and upwardly. A connector 63 connects water inlet 24 to manifold 60. Connector 64 connects manifold 62 to oulet valve 42.

Fitting over the above manifold assembly is a foot-sole receiving grid 66 secured to posts 52 at each corner by screws threaded in the posts and passing through corner openings 68 in grid 66.

Rectangular grid 66 has a central divider 69 separating foot-receiving plastic screen sections 70 and 72 corresponding to the left and the right foot, respectively.

Preferably, the screen openings are square and ¼ inch on a side. The screen sections receive jets of water from the opening 61 which they split to give a foot massage effect to feet.

The degree of turbulence of the liquid can be increased by opening valve 42.

The unit of the invention gives the feet a massaging shower which refreshes, relaxes, activates blood circulation, softens calluses and avoids tired and aching feet. Either hot or cold water can be used.

The operation and use of the invention hereinabove described will be evident to those skilled in the art to which it relates from a consideration of the foregoing.

It will thus be seen that there is provided a device in which the several objects of this invention are achieved, and which is well adapted to meet the conditions of practical use. The useful features of the invention are easily seen.

It is thought that persons skilled in the art to which this invention relates will be able to obtain a clear understanding of the invention after considering the foregoing description in connection with the accompanying drawing. Therefor, a more lengthy description is deemed unnecessary.

It is to be understood that various changes in shape, size and arrangement of the elements of this invention as claimed may be resorted to in actual practise, if desired.

Having thus described the invention, what is claimed as new and to be secured by Letters Patent is:

1. A portable foot massaging hydro-therapy unit comprising a tank adapted to be connected to a faucet of a bathtub, a plate fitting in the bottom of said tank; a manifold assembly connected to said faucet, said assembly being held on said plate and including a plurality of connecting conduits each having spaced discharge openings for discharging water outwardly and upwardly; a foot-sole receiving grid fitting over said assembly and receiving water from said openings; said grid having spaced screen sections resulting in a foot massage effect to feet thereon.

2. The invention as recited in claim 1 wherein said manifold assembly includes a pair of spaced sections each having from 5 to 6 connecting conduits.

3. The invention as recited in claim 1, wherein screen openings in said screen sections are about $\frac{1}{4}$ inch on a side.

* * * * *